US005908525A

United States Patent [19]

Zaher

[11] Patent Number: 5,908,525

[45] Date of Patent: Jun. 1, 1999

[54] METHOD AND APPARATUS FOR APPLYING A DECORATION TO AN ARTICLE

[76] Inventor: Maximilian Zaher, Butjadinger Strasse 330, D-26125 Oldenburg, Germany

[21] Appl. No.: 08/947,407

[22] Filed: Oct. 8, 1997

[30] Foreign Application Priority Data

Oct. 31, 1996 [EP] European Pat. Off. ..... 96117502

[51] Int. Cl.[6] ..... B44C 1/165; B44C 31/00; B41M 3/12; B05C 3/00

[52] U.S. Cl. ..... 156/230; 156/155; 156/236; 156/240; 156/540; 156/542; 156/DIG. 5; 427/149; 427/430.1; 118/402; 118/404; 101/33; 101/34

[58] Field of Search ..... 156/155, 230, 156/235, 236, 239, 240, 241, 277, 384, 540, 541, 542, 581, DIG. 5; 118/402, 403, 404, 405; 101/33, 34, 35, 379; 427/149, 262, 263, 281, 430.1, 434.3, 434.5, 434.7

[56] References Cited

U.S. PATENT DOCUMENTS

| | | | |
|---|---|---|---|
| 3,671,288 | 6/1972 | Rosenberg | 117/39 |
| 4,010,057 | 3/1977 | Nakanishi | 156/384 |
| 4,229,239 | 10/1980 | Arai et al. | 156/155 |
| 4,231,829 | 11/1980 | Marui et al. | 156/230 |
| 4,269,650 | 5/1981 | Arai et al. | 156/540 |
| 4,348,246 | 9/1982 | Nakanishi | 156/73.1 |
| 4,388,866 | 6/1983 | Nakanishi | 101/426 |
| 4,407,881 | 10/1983 | Shima et al. | 428/156 |
| 4,436,571 | 3/1984 | Nakanishi | 156/384 |
| 4,490,413 | 12/1984 | Stimson | 427/262 |

FOREIGN PATENT DOCUMENTS

| | | |
|---|---|---|
| 0424258 | 4/1991 | European Pat. Off. . |
| 2645077 | 10/1990 | France . |
| WO9113114 | 9/1991 | WIPO . |
| WO9210926 | 7/1992 | WIPO . |

OTHER PUBLICATIONS

European Search Report. EP 96 11 7502 dated Apr. 1, 1997.

*Primary Examiner*—David A. Simmons
*Assistant Examiner*—J. A. Lorengo
*Attorney, Agent, or Firm*—Webb, Ziesenheim, Logsdon Orkin & Hanson, P.C.

[57] ABSTRACT

For applying a decoration to an article, the decoration with a supporting film is arranged on the surface of a liquid in a tank and is extended and/or condensed parallel to the surface according to requirements depending on the shape of the article to be printed. The article is immersed into the liquid in order to transfer the decoration onto the article. For the extending and/or condensing of the decoration on the surface of the liquid, nozzles are arranged below the surface of the liquid and produce flows in the water.

16 Claims, 2 Drawing Sheets

METHOD AND APPARATUS FOR APPLYING A DECORATION TO AN ARTICLE

BACKGROUND OF THE INVENTION

1. Field of the Invention

The invention relates to a method and apparatus for applying a decoration to an article whereby the decoration is arranged on the surface of a liquid and extended and/or condensed according to the shape of the article prior to the article being immersed into the liquid to transfer the decoration onto the article.

2. Background of the Prior Art

U.S. Pat. No. 4,010,057, corresponding to German Patent No. DE-A-25 34 640, describes a method and apparatus for applying a decoration to an article using hydrostatic pressure. This patent is hereby incorporated by reference. However, this patent neither teaches nor suggests extending or condensing the decoration so that it better conforms to the shape of the article prior to transferring the decoration to the article.

U.S. Pat. No. 4,348,246 describes a transfer printing technique in which the film with the decoration to be transferred is not placed upon a layer of water but instead is placed upon a layer of granules of such fine grains that the decoration and the supporting granules conform to the curved surface of the article, thereby enhancing the contact of the decoration against the article.

U.S. Pat. No. 4,388,866 describes a transfer printing technique in which the film with the decoration to be transferred is placed upon a deformable layer of pins which can be adapted to the shape of the article, thereby enhancing the contact of the decoration against the article.

U.S. Pat. No. 4,436,571 describes a transfer printing technique in which the article to receive a decoration is immersed in a specific way into a flowing liquid with the decoration floating thereupon. The article is presented to the decoration in a continuous movement in the general direction of the liquid flow along a downward path oblique to the surface of the liquid and then along an upward path oblique to the surface of the liquid to provide contact between the decoration and the article.

U.S. Pat. No. 4,229,239 describes another transfer printing technique in which the decoration is prepared before the transfer by a solvent in order that it detaches itself more easily from the supporting film.

U.S. Pat. No. 4,407,881, corresponding to DE-A-32 19 992, describes a transfer printing technique in which the decoration is supported on a layer of a special film made of a hydrophilic, deformable layer which can swell by absorption of water, and a further layer which is placed over the hydrophilic layer and is varyingly permeable to water so that the hydrophilic layer expands to a greater or lesser extent.

U.S. Pat. No. 4,231,829 describes another transfer printing technique in which boric acid or a salt thereof is added to a PVA film supporting the decoration on the liquid or to the water on which the decoration floats in order to promote the transfer process.

U.S. Pat. No. 4,269,650 also describes a transfer printing technique utilizing the addition of a solvent in order to make the detachment of the decoration from the supporting film easier.

The decoration (also referred to as printing pattern) on a film which supports the decoration is applied to a water surface and is extended (stretched) and/or condensed (compressed) there. For this extending or condensing of the floating supporting film with decoration, the prior art discloses air blowers which are arranged above the film with decoration in order to use an air flow to extend and/or condense the decoration with the film, i.e., extend it in specific directions according to the shape of the article to be printed and, if appropriate, condense it in other directions.

An object of the invention is to develop a method and apparatus for transferring a decoration to an article in such a way that the decoration may be shaped before the decoration is transferred to the article so the decoration better conforms to the article even when the article has a complicated three-dimensional shape.

SUMMARY OF THE INVENTION

The apparatus of the present invention is directed to applying a decoration to an article, in which the decoration may or may not be attached to a supporting film, wherein the apparatus is comprised of a tank through which a liquid flows, a device for placing the decoration or the decoration and supporting film onto the surface of the liquid, a device for producing fluid flow, a device for directing fluid flow upward from below the surface of the liquid and against the decoration on the surface of the liquid to selectively deform the decoration in a direction parallel to the surface of the liquid to accommodate the shape of the article, and means for immersing at least part of the article into the liquid against the decoration to transfer the decoration to the article.

The method of the present invention is directed to applying a decoration to an article in which the decoration floats on the surface of a liquid and the article is immersed over the decoration at least partially into the liquid in order to transfer the decoration onto the article, the method comprising the steps of producing a fluid flow below the surface of the liquid and deforming with the fluid flow below the surface of the water the decoration in a direction parallel to the surface of the liquid to accommodate the shape of the article.

Nozzles are preferably provided as means for producing flows in the liquid to deform the decoration. The nozzles can preferably be adjusted according to choice with regard to various parameters, such as water pressure, the flow velocity, the mass flow rate and also in particular the flow direction, to accomplish complete control of the film shape and to permit as fast as possible transfer printing. On the basis of the adjustable liquid flow, the correspondingly shaped film moves very quickly in the desired direction and assumes the desired shape, so that thereafter the article to receive the decoration can be immersed into the liquid on which the film with decoration is floating, so that the decoration may be transferred to the article.

The technique described can be used both for extending and/or condensing decorations which are floating on the surface on a correspondingly shaped supporting film and for decorations which are floating directly (without supporting film) on the surface of the liquid, provided that the decoration has adequate stability.

According to a preferred embodiment of the invention, the apparatus is provided with rollers close to the surface of the liquid, which are vertically adjustable relative to the surface of the liquid. With such rollers, the surface of the water can be calmed. In particular, waves and irregular (unwanted) flows on the surface can be prevented. The rollers typically lie just below the surface of the water or are just touching the surface. With the rollers, the film and the decoration can be supported so that they slide uniformly over or with the surface of the water. At least one of these rollers is provided with a rotary drive so that the rollers can be rotated.

The rollers can also be used to adjust the advancing speed of the film with respect to the flow velocity of the surface of the water. This makes it possible to adjust the film advancing speed to be different than the flow velocity of the surface of the water. For example, the film advancing speed may be increased with respect to the water velocity if, in the case of certain articles to be printed, such an acceleration of the film leads to good results. If, for example, the article to be printed is immersed relatively quickly, a tearing of the film and of the decoration can be prevented by the rollers being rotated somewhat faster and thus the film advancement accelerated. The rollers also provide a hydrodynamic separation of the tank into a downstream part, in which the immersion process for transferring the decoration onto the article is carried out, and an upstream part, in which the film with the decoration is placed onto the surface of the water.

According to a preferred embodiment, a plurality of rollers is arranged one behind the other in the flow direction and the vertical position relative to the surface of the water and the rotation of each roller may be adjusted independent of the other rollers.

The rollers also allow controlling of the process in such a way that the film is utilized to the maximum. Only as much film with decoration as is required for the desired printing of the article need be used. The rollers also stabilize the film against undesired disturbing influences. The rollers are preferably provided with a smooth surface, for example, of stainless steel.

According to a further preferred embodiment of the invention, the rollers are adjustable not only with regard to their rotational speed and vertical height but also in the horizontal direction parallel to the surface of the water, both absolutely with respect to the tank and relatively with respect to one another. The distance of the rollers with respect to one another can be adjusted in order to optimize the various effects mentioned above to accommodate different articles.

A further preferred embodiment of the invention provides that the feeding of the liquid into the tank takes place through two rollers which are arranged at the inlet of the tank. As a result, a uniform and homogeneous flow is achieved, particularly on the surface. The position with respect to the surface of the water and the rotational speed of one or both rollers are preferably adjustable. The two rollers are arranged approximately vertically one above the other but spaced apart sufficiently to leave a very narrow, horizontal gap free between them. This gap lies approximately at the level of the surface of the water. Consequently, the flow of water into the tank, and consequently also the flow velocity, can be controlled in a way corresponding to the requirements of the article on which the decoration will be applied.

According to a preferred embodiment of the invention, at least one of the rollers may also serve to measure the height of the water level as input to the computer controlling the process. For example, a pressure sensor can be used to measure the water pressure acting on the roller. The pressure may be used to measure the height of the water level, if the sensor on the roller is kept at a certain height in the vertical direction.

A further preferred embodiment of the apparatus according to the invention provides that two rollers are arranged next to each other at the downstream end of the tank, close to the surface of the liquid, in such a way that film residues and/or decoration residues run over both rollers, and the residues are isolated from the remaining portion of the tank. These residues may be filtered, thereby permitting a clean liquid to return to circulation in the tank. Additionally, the gap between the rollers permits relatively clean liquid to pass downward to return to circulation in the tank.

BRIEF DESCRIPTION OF THE DRAWINGS

An exemplary embodiment of the invention is described in more detail below with reference to the drawings, in which.

DESCRIPTION OF THE PREFERRED EMBODIMENTS

Figure 1:
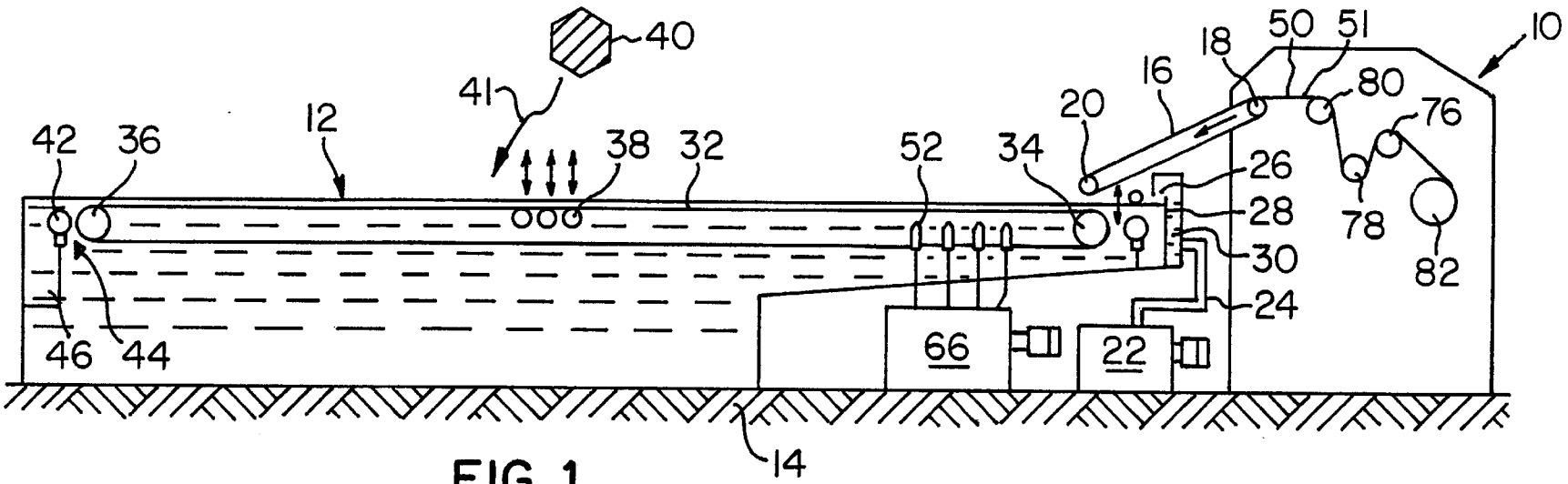
FIG. 1 schematically shows from the side an apparatus for applying a decoration to an article.

FIG. 1 shows a transfer printing apparatus. On the right is a housing 10 in which a supporting film 50 having a series of decorations 51 on its upper side is fed by means of rollers 82, 76, 78, 80, 18, 20 to a tank 12 filled with a liquid such as water. The decorations are separated from one another on the supporting film 50 and restrained relative to one another only by the supporting film 50. The chemical and physical structure of the film is not the subject of this invention, nor is the chemical and physical structure of the decoration applied to the film. Such decorations and supporting film are well known to those skilled in the art.

The housing 10 and the water tank 12 stand on a common foundation 14 which isolates and supports the entire transfer printing installation in such a way that outside mechanical disturbing influences are greatly diminished.

Film 50 with the decoration 51 is brought from the housing 10 to the surface of the water in the tank 12 by means of a film feed 16 in the form of an obliquely running conveyor belt. The conveyor belt of the film feed 16 runs over rollers 18, 20.

Figure 2:
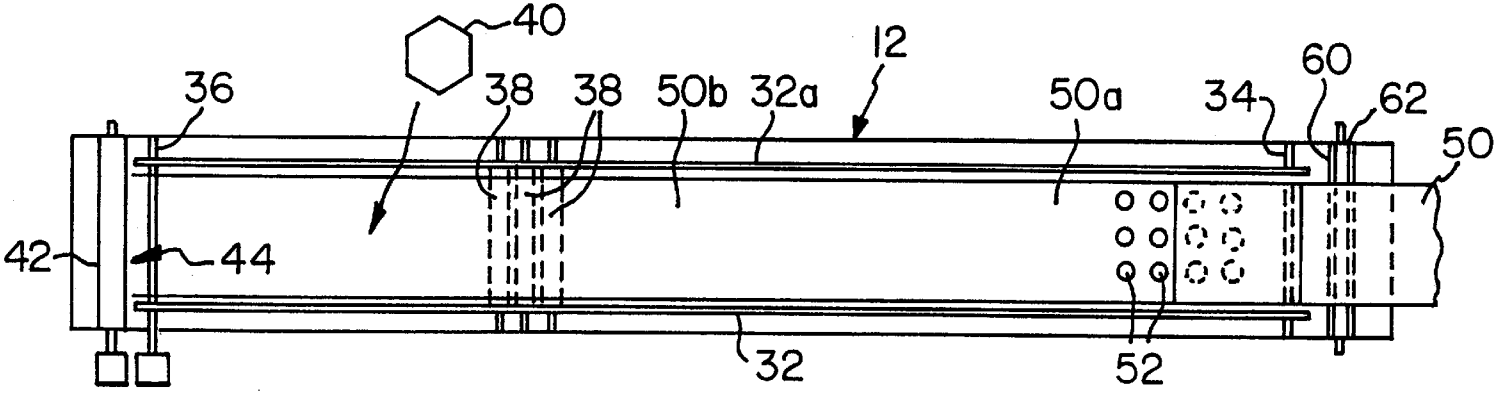
FIG. 2 shows a schematic of a plan view of the apparatus according to FIG. 1.
Figure 3:
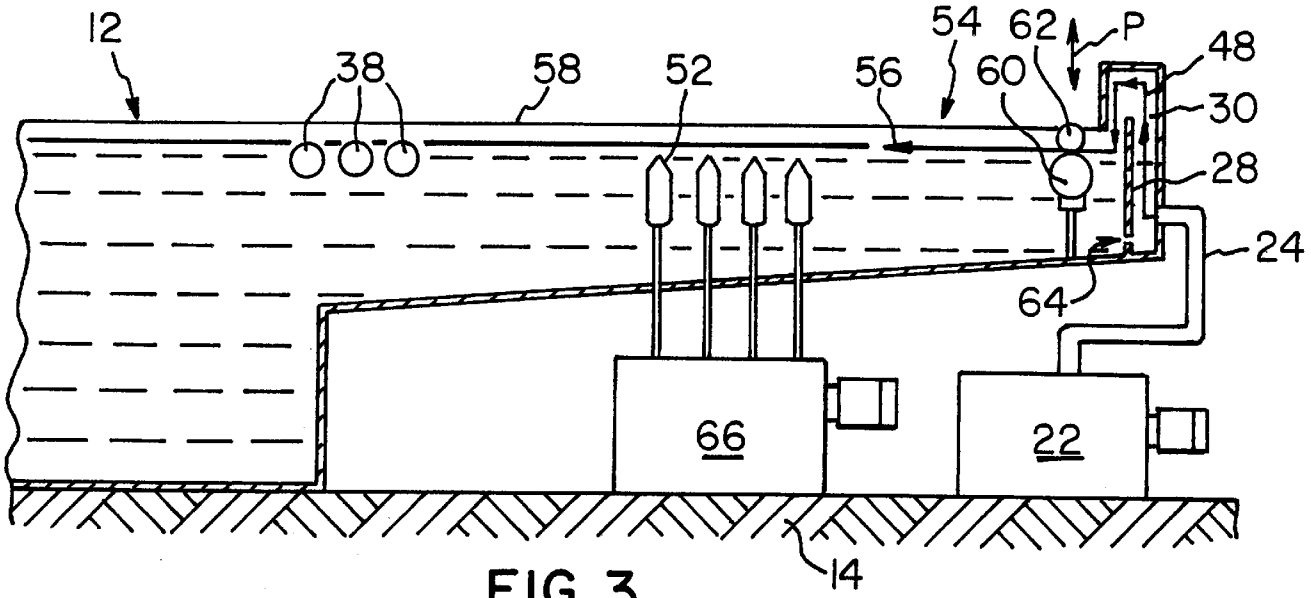
FIG. 3 shows a schematic of a side view of an upstream section of the apparatus according to FIG. 1.

In FIG. 1, and in each of the FIGS. 1–3, the water flows from right to left through the tank 12. For this purpose, a pump 22 is provided which maintains water circulation. A supply line 24 leads from the pump 22 into a cavity 30. The cavity 30 is filled and water is pumped over a dam wall 28 at a height which lies above the surface of the water in the tank 12 to water inflow 26.

The flow path of the water is shown in more detail by arrow 48 in FIG. 3, and the introduction of the water into the tank 12 is described more precisely further below.

The film 50 and the decoration 51 are presented to the tank 12 by means of the film feed 16 which is advanced in the direction of the water flow. Film feed 16 is comprised of a rotating conveyor belt which runs over rollers 18, 20. Guide belts 32, 32*a* are laterally spaced and run over rollers 34, 36, which extend across the width of the tank 12.

The process of transferring the decoration to an article by immersing the article against a decoration floating on the surface of a liquid is well known by those skilled in the art and is discussed in the prior art patents previously identified.

Means for immersing an article 40 into the liquid against the decoration 51 to transfer the decoration to the article 40 are also well known by those skilled in the art and are discussed in prior art patents previously identified. As an example, U.S. Pat. No. 4,010,057 discloses a means for immersing an article comprised of a liquid pressure actuating cylinder which lifts and lowers an arm. The arm extends over the liquid on which the decoration floats. At the end of the arm is a holding section used to hold the article. The article then may be lowered into or lifted from the liquid by the activation or deactivation of the actuating cylinder.

The holding section can be designed in accordance with the shape of the article. As an example, in the event the article is box-like and has interior walls, the holding section may be made of arms which pivot outwardly to press against and engage the interior walls of the article. However, not only may the water be used to hydrostatically support the decoration, but the water may also be used to deform the decoration for accommodating the shape of an article to be decorated and it is this feature to which the subject invention relates.

Figure 5:
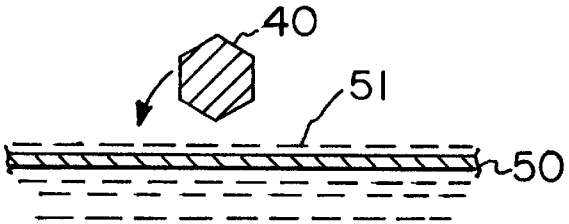
FIG. 5 shows a schematic view of an article to be decorated prior to the transfer of the decoration.

Returning to FIG. 1, the article 40 to receive the decoration 51 is immersed from above into the water in the tank 12 at a location marked by an arrow 41. At the same time, the film with the decoration is floating on the surface of the water, approximately at the height of the lateral guide belts 32, 32*a*. The article 40 is immersed over the decoration 51 such that the hydrostatic pressure on the floating decoration 51 urges the decoration 51 against the article 40. FIG. 5 schematically shows the immersion of the article 40 into the liquid on which the supporting film 50 and the decoration 51 are floating. During this immersion, the decoration 51 is subjected to hydrostatic pressure from the liquid which urges the floating decoration 51 to conform three-dimensionally around the article 40 and adheres to the article 40. By this technique, it is possible to print true to scale onto complicated three-dimensional articles. In this process, there remain in the flowing water residues of the film and of the decoration which cannot be further used. For example, in the prior art a film of PVA (polyvinyl alcohol), which is more or less soluble in water, is used.

The roller 36, in addition to supporting the guide belts 32, 32*a*, has an additional function in conjunction with roller 42, which is located downstream of roller 36 and extends across the entire width of the tank 12. Rollers 36 and 42 promote separation of film residues and decoration residues. These rollers are arranged such that a narrow gap 44 is left free between them. Film residues and decoration residues transported over the roller 36 reach the roller 42 and are transported further by the rotation of roller 42. These residues reach a filter 46 which separates the film residues and decoration residues from the water and discharges clean water into the lower region of the tank 12 and back to the pump 22. Also, through the narrow gap 44 between the rollers 36 and 42, relatively clean water returns into lower regions of the tank 12.

FIGS. 2 and 3 show schematic drawings of the apparatus from above and from the side. FIG. 3 illustrates details of the introduction of water into the tank. As already stated above with reference to FIG. 1, the water rises in the cavity 30 over the dam wall 28 and falls from there into the tank 12. Provided underneath the dam wall 28 is an opening 64 (FIG. 3) through which excess water can enter directly into the tank 12.

In FIG. 3, the path of the water over the dam wall 28 is diagrammatically represented by arrow 48 and the associated solid line. The water is fed through an intermediate space between two rotating rollers 60, 62 into the tank. The two rollers 60, 62 are arranged vertically one above the other and are adjustable vertically in the direction of an arrow P. While preferably both rollers 60, 62 have rotary drives, at least one roller, such as the lower roller, has a rotary drive. The rotational speed of the rollers is such that the water is transported in a direction corresponding to an arrow 56. The arrow 56 also marks the surface of the water in the tank 12.

In FIG. 3, the lower roller 60 thus rotates counterclockwise and the upper roller 62 rotates clockwise. By adjusting the rollers 60, 62 in their vertical height, adjusting their distance from each other and adjusting the rotational speed, the flow of the water into the tank can be optimally controlled. For example, the distance between the two rollers may be about 1 cm depending on the requirements of the article to be printed. The distance is used to control the rate water is introduced to the upstream end of the tank 12. The rotational speed of the rollers (mainly of the lower roller 60) can be used to influence the flow velocity at the surface indicated by the arrow 56 in the tank 12. The rollers 60, 62 are preferably made with a smooth surface, for example, of stainless steel.

The level of the water in the tank 12 is continuously measured by means of a sensor (not shown). Any of a number of commercially available sensors is suitable. This information about water level is passed to a computer, which controls all the adjustable components and evaluates this information correspondingly. For example, if waves occur, the computer can alter the rotation, position and distance apart of the rollers 60, 62 in order to prevent the occurrence of waves and to keep the surface of the water calm.

It is possible to deform by extending or condensing the film 50 with the decoration 51 printed on it after the film 50 is introduced to the water of the tank 12. The film 50, with the decoration printed on it, is transported down from the film feed 16 and reaches the surface of the water in the tank 12 approximately at a point 54. There it floats on the surface and is carried along by the flow.

Figure 4B:
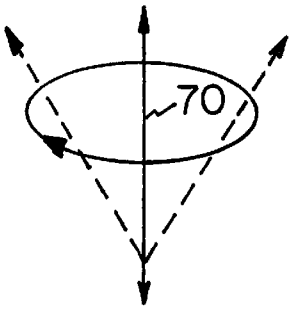
FIG. 4B shows a schematic view of the range of rotation available with each nozzle.
Figure 4A:
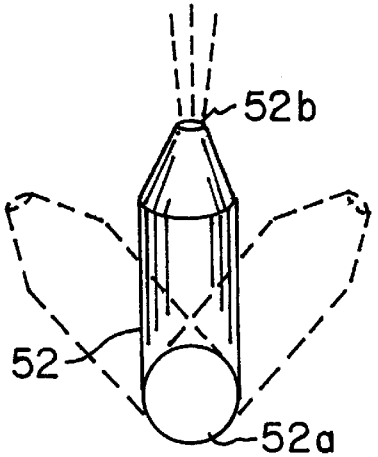
FIG. 4A schematically shows a nozzle for producing a water flow in a variety of different directions.

Arranged below the surface of the water in the tank 12 is a plurality of nozzles 52 capable of directing the water to flow in various directions. FIG. 4A shows a typical nozzle 52 schematically in an enlarged representation. Each nozzle may be spatially positioned, according to choice, for changing the flow directions, depending on the desired shaping of the film in a way corresponding to the article to receive the decoration. FIG. 4B shows schematically the adjustability of the flow direction by means of a nozzle 52 pivotable about a base 52*a* and having a discharge orifice 52*b*. An axis 70 defines the flow direction of the nozzle 52, which is adjustable in an inclined manner with respect to the surface of the water as indicated by arrow 56.

According to the plan view of FIG. 2, an array of nozzles, for example, an array of twelve nozzles in a 3×4 arrangement, is positioned in such a way that desired flows can be produced virtually at any point of the surface of the water indicated by arrow 56. The nozzles 52 discharge a water flow upwards or obliquely upwards in order to extend or condense the stretchable and compressible film. In the region 50*a* (FIG. 2), the film 50 floating on the surface of the water indicated by arrow 56 in the tank is thus extended or condensed in a way corresponding to the requirements of the article to be printed (not shown). It is also possible to orient the nozzles 52 so that water flow is directed to extend one or more portions of the decoration while condensing one or more other portions of the decoration.

In FIG. 1, a pump 66 used to drive the water through the nozzles 52 is represented. Above the pump four arrows, which symbolize the individual nozzles 52, are shown. It should be understood that while a 3×4 array of nozzles has been disclosed, any number of nozzle patterns may be suitable to extend or condense the film 50 and the associated decoration 51 and the invention should not be limited to this one specific arrangement.

In a region 50*b,* the film 50 with the decoration 51 has reached its desired (extended or condensed) shape and is transported downstream over a plurality of rollers 38. The rollers 38 are adjustable in their height in such a way that each of their upper edges is approximately flush with the surface of the water indicated by arrow 56. The rollers 38 are preferably formed with a smooth surface, for example, of stainless steel. Preferably, each of the rollers 38 has a rotary drive and may be adjusted for rotational speed and height. The rollers 38 can be used to calm the surface of the water, in particular downstream (to the left) and also to stabilize the advancement of the film. If need be (depending on the article receiving the decoration), the rollers 38 can also be used to adjust the advancing speed of the film to be faster or slower than the flow velocity of the water. The former is advisable in particular whenever the article to be printed has to be immersed very deeply into the tank or when the article has to be immersed quickly. Increasing the advancing speed of the film relative to the flow velocity of the water then prevents a tearing of the film.

In the case of the embodiment illustrated, three rollers 38 are provided which are cylindrical and independently with respect to one another adjustable for vertical position, rotational speed and horizontal distance. The rollers 38 can be used to control the feeding in of the decorative film 50 as it progresses downstream.

While the discussion has been directed to a supporting film 50 with a decoration 51 upon it, it is possible, if the decoration 51 has enough stability and strength, for the decoration 51 to be processed and transferred to an article without the need for a supporting film 50. However, in this case there would be a continuous strip of decorations that must be separated to accommodate each article.

Although the invention has been described with reference to a specific embodiment, numerous modifications are possible without departing from the invention, and it is desirable to cover all modifications falling within the spirit and scope of this invention.

What is claimed is:

1. A method for applying a decoration to an article in which the decoration floats on the surface of a liquid and the article is immersed over the decoration at least partially into the liquid in order to transfer the decoration onto the article, the method comprising steps of:

a) producing a an upwardly directed fluid flow below the surface of the liquid; and b) deforming, with the fluid flow below the surface of the liquid, the decoration in a direction parallel to the surface of the liquid to accommodate the shape of the article.

2. The method according to claim 1 wherein the decoration has a supporting film attached and the step of deforming the decoration further includes simultaneously deforming the attached supporting film.

3. The method according to claim 1 wherein the step of deforming comprises one or both of selectively extending and condensing portions of the decoration.

4. The method according to claim 3 wherein the step of producing a fluid flow below the surface of the liquid is comprised of pumping fluid through nozzles located below the surface of the liquid.

5. The method according to claim 4 wherein selectively extending and condensing portions of the decoration are accomplished by orienting the nozzles in a fashion to produce the desired deformation.

6. The method according to claim 4 wherein selectively extending and condensing portions of the decoration are accomplished by adjusting the flow pressure at each nozzle to produce the desired deformation.

7. The method according to claim 4 wherein selectively extending and condensing portions of the decoration are accomplished by adjusting the flow velocity at each nozzle to produce the desired deformation.

8. The method according to claim 4 wherein selectively extending and condensing portions of the decoration are accomplished by adjusting the mass flow rate at each nozzle to produce the desired deformation.

9. An apparatus for applying a decoration to an article, in which the decoration may or may not be attached to a supporting film, wherein the apparatus is comprised of:

a) a tank through which a liquid flows;

b) a device for placing the decoration or the decoration and supporting film onto the surface of the liquid;

c) a device for producing fluid flow;

d) a device for directing fluid flow upward from below the surface of the liquid and against the decoration on the surface of the liquid to selectively deform the decoration in a direction parallel to the surface of the liquid to accommodate the shape of the article; and e) means for immersing at least part of the article into the liquid against the decoration to transfer the decoration to the article.

10. The apparatus according to claim 9 wherein the device for producing fluid flow is a pump.

11. The apparatus according to claim 10 wherein the device for directing fluid flow is a plurality of nozzles.

12. The apparatus according to claim 11 wherein each of the nozzles is pivotable.

13. The apparatus according to claim 9 further including rollers provided close to the surface of the liquid and wherein the rollers are adjustable in height with respect to the surface of the liquid to attenuate waves that may exist in the tank.

14. The apparatus according to claim 13 wherein at least two of the rollers have rotary drives.

15. The apparatus according to claim 9 further including two vertically mounted rollers positioned at the upstream side of the tank, wherein the rollers are vertically separated to define a gap which limits the quantity of water that may enter the tank.

16. The apparatus according to claim 9 further including at least two additional rollers arranged at the downstream end of the tank next to each other but spaced apart to define a gap, wherein the rollers are close to the surface of the liquid such that residue from the transfer operation runs over both rollers and is isolated in the tank, while relatively clean liquid passes downwards through a gap between the rollers.

* * * * *

UNITED STATES PATENT AND TRADEMARK OFFICE

CERTIFICATE OF CORRECTION

PATENT NO. : 5,908,525

DATED : June 1, 1999

INVENTOR(S) : Maximilian Zaher

It is certified that error appears in the above-identified patent and that said Letters Patent is hereby corrected as shown below:

Column 7 Line 54 Claim 1 paragraph a), after "producing" delete --a--.

Signed and Sealed this

Thirtieth Day of November, 1999

*Attest:*

*Attesting Officer*

Q. TODD DICKINSON

*Acting Commissioner of Patents and Trademarks*